US007549255B2

(12) United States Patent
Kirkwood

(10) Patent No.: US 7,549,255 B2
(45) Date of Patent: Jun. 23, 2009

(54) MODULAR SYSTEM FOR CONSTRUCTING PLATFORM AND SHELVING STRUCTURES

(76) Inventor: David Kirkwood, 3233 Friar La., Dallas, TX (US) 75044

( * ) Notice: Subject to any disclaimer, the term of this patent is extended or adjusted under 35 U.S.C. 154(b) by 0 days.

(21) Appl. No.: 11/930,443

(22) Filed: Oct. 31, 2007

(65) Prior Publication Data

US 2008/0047918 A1 Feb. 28, 2008

Related U.S. Application Data

(63) Continuation-in-part of application No. 11/233,336, filed on Sep. 22, 2005.

(51) Int. Cl.
*E04B 1/346* (2006.01)
*E04B 7/16* (2006.01)
*E04B 1/00* (2006.01)

(52) U.S. Cl. ..... 52/69; 52/79.1; 52/79.5; 52/79.9; 52/66; 52/68; 52/70

(58) Field of Classification Search ..... 52/64, 52/70, 144, 69, 79.1, 79.5, 79.9, 66, 68; 312/108, 312/257.1, 107, 111; 211/134, 186, 189, 211/195, 175, 183; 296/173, 163
See application file for complete search history.

(56) References Cited

U.S. PATENT DOCUMENTS 2,259,783 A * 10/1941 Sparling ..... 52/69
2,550,088 A * 4/1951 Sayer ..... 220/6
3,706,171 A * 12/1972 Shayman ..... 52/506.08
3,792,557 A * 2/1974 Pitts ..... 52/65
4,071,286 A * 1/1978 Moyer ..... 312/348.3
4,742,653 A * 5/1988 Napier et al. ..... 52/66
4,867,513 A * 9/1989 Choi ..... 312/258
4,883,443 A * 11/1989 Chase ..... 446/478
5,493,818 A * 2/1996 Wilson ..... 52/71
6,085,861 A * 7/2000 Jines ..... 181/30
6,244,502 B1 * 6/2001 Hollar et al. ..... 229/120.11
6,321,871 B1 * 11/2001 Russell ..... 181/295
6,601,929 B2 * 8/2003 Marihugh ..... 312/108
6,854,599 B2 * 2/2005 Ferrara et al. ..... 206/438
6,872,413 B2 * 3/2005 Rosenblum ..... 426/324
2003/0007654 A1 * 1/2003 Azima ..... 381/152
2003/0066707 A1 * 4/2003 Quam et al. ..... 181/287

* cited by examiner

*Primary Examiner*—Richard E Chilcot, Jr.
*Assistant Examiner*—Mark R Wendell
(74) *Attorney, Agent, or Firm*—Roger S. Burleigh

(57) ABSTRACT

Modular system for platform and shelving structures. In an assembled configuration, a module has a central vertical member hingedly-coupled to a second vertical member extending perpendicular to a first side of the central member, and a horizontal member hingedly-coupled to the central member and extending perpendicular to a second side of the central vertical member. The upper edges of the central vertical member and the second vertical member of a first module provide support to a horizontal member of a second module, whereby various structures can be formed from a plurality of modules. Each module is stowable by rotating the second vertical member and the horizontal member about their hinged edges toward the central vertical member. One or more of the members can include key portions adapted to interlock with a member of an adjacent module when in an assembled configuration.

17 Claims, 17 Drawing Sheets

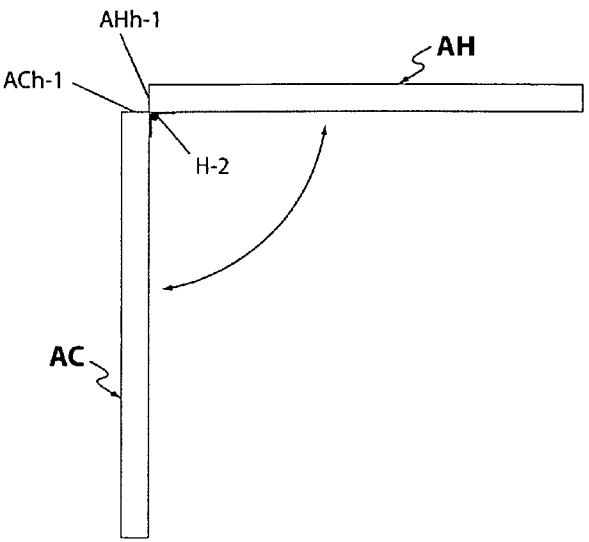
FIG. 2-A
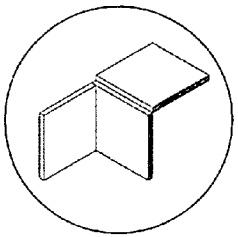
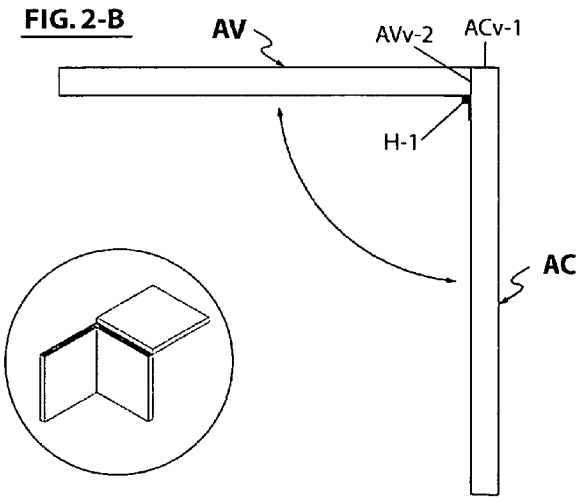
FIG. 2-B
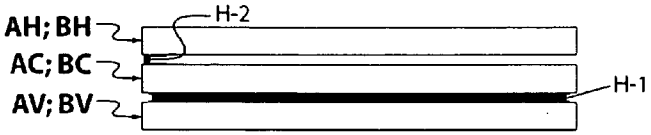
FIG. 2-C

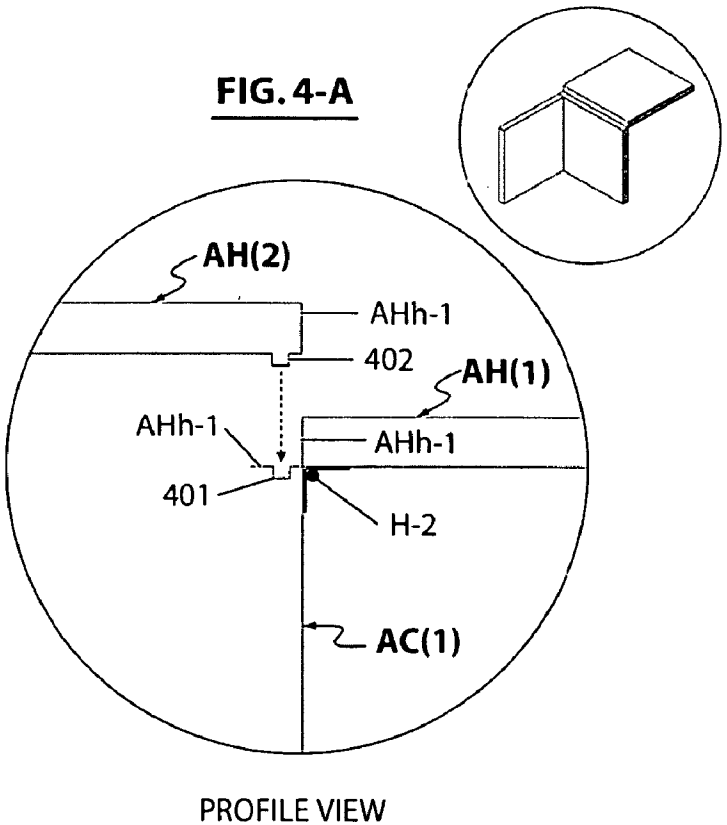
FIG. 4-A
PROFILE VIEW
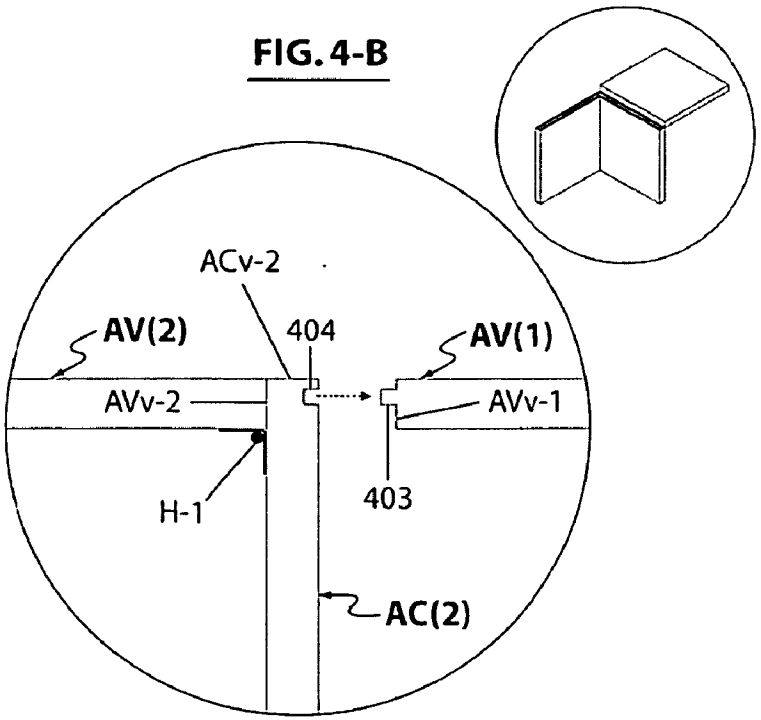
FIG. 4-B
OVERHEAD VIEW

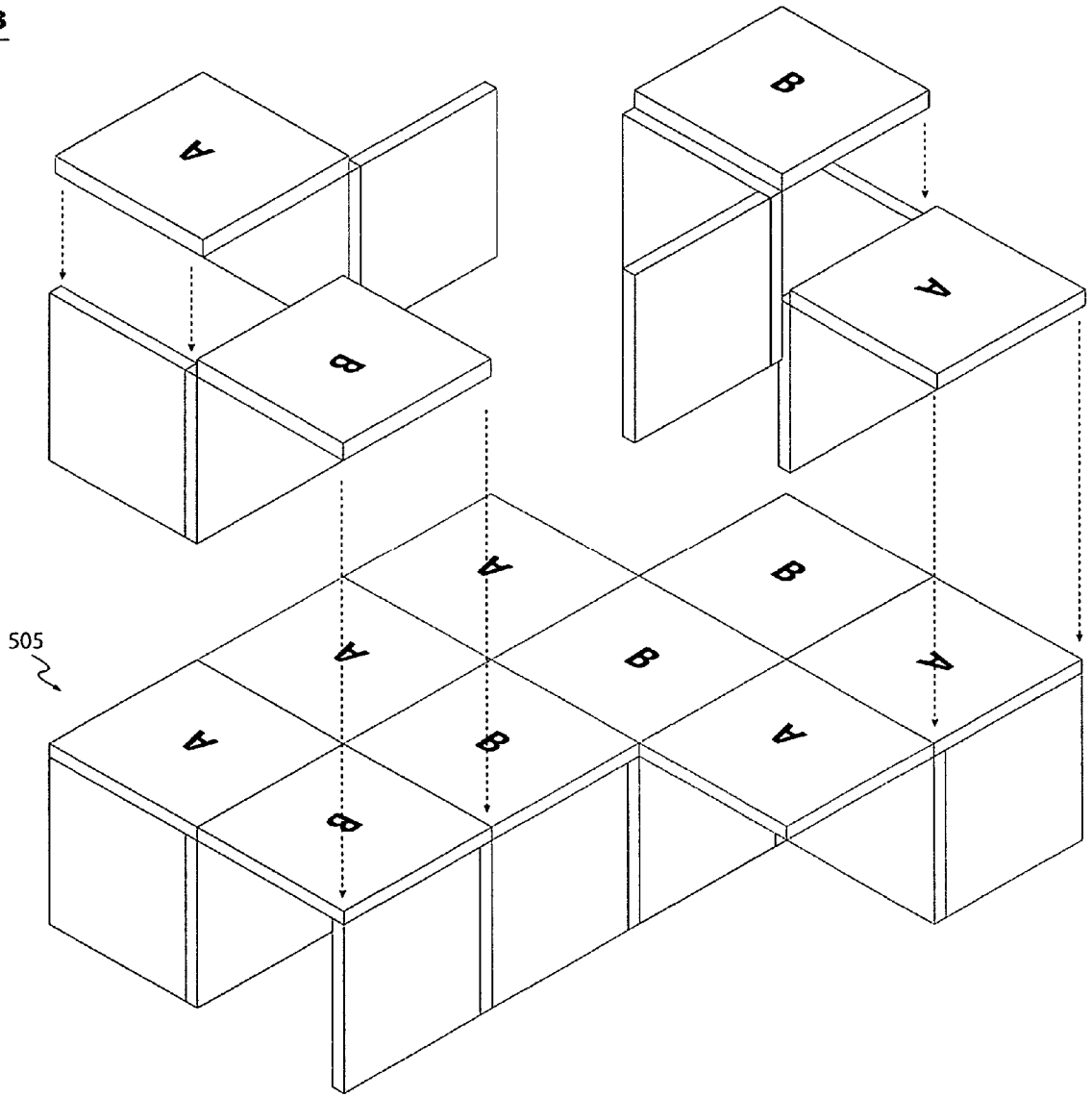
FIG. 5-B

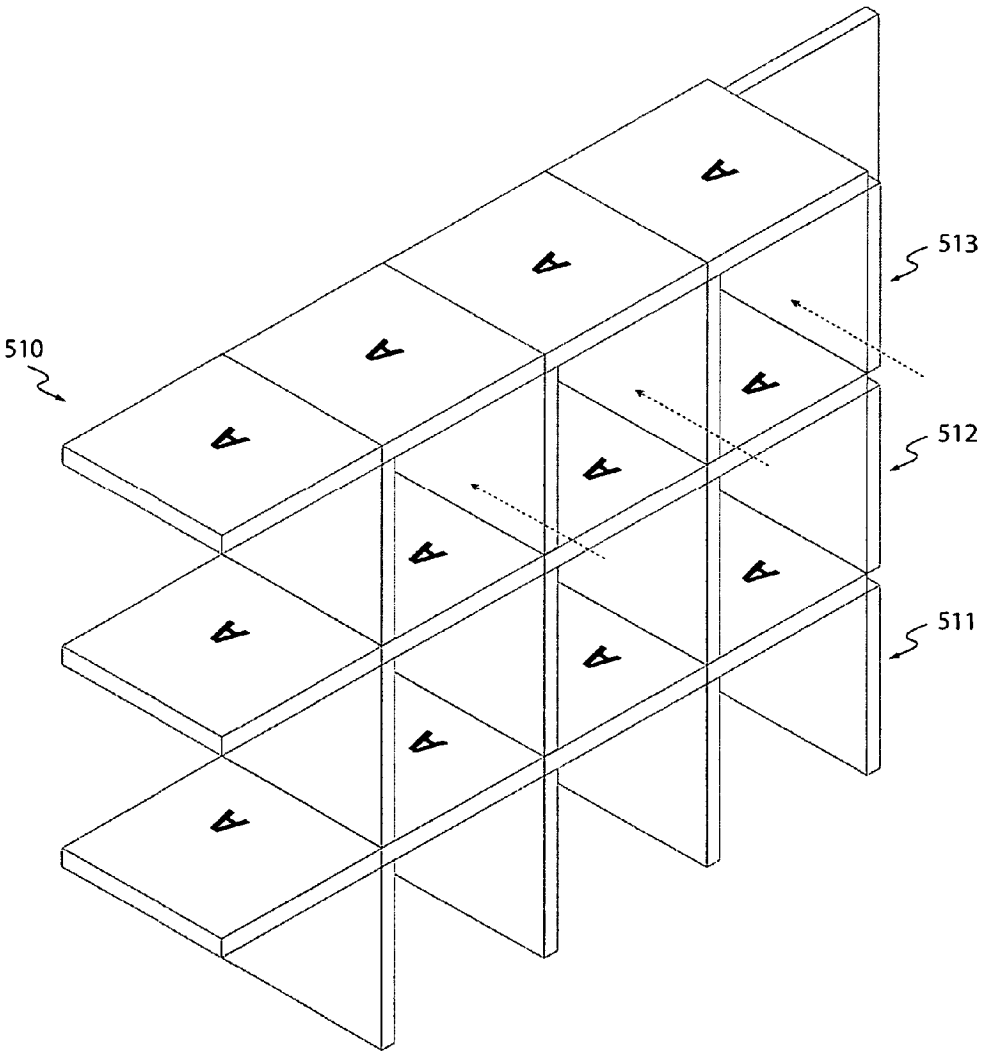
FIG. 5-C

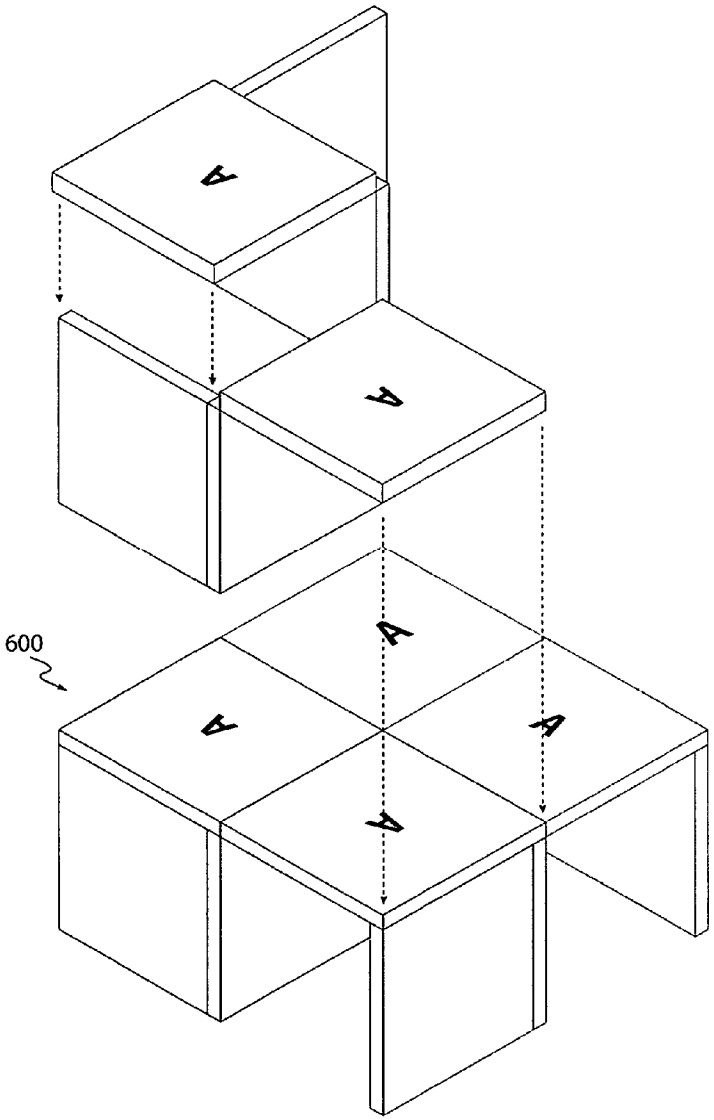
FIG. 6-A

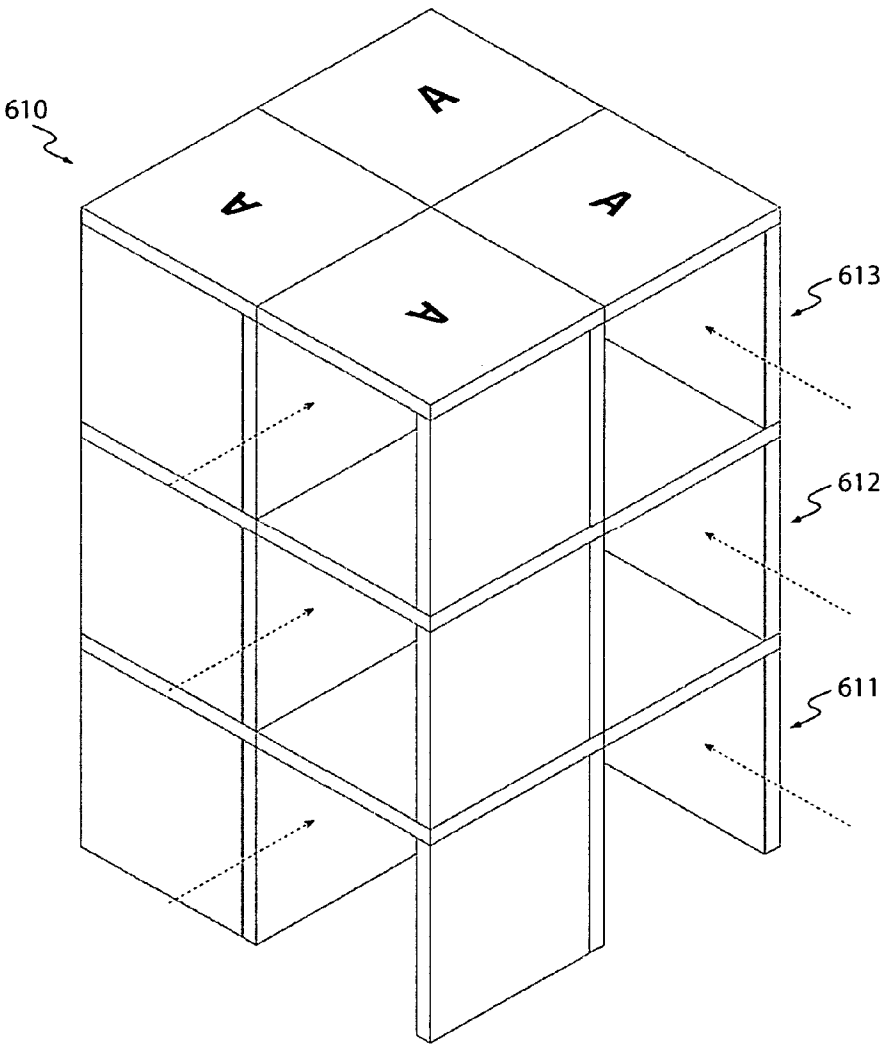
FIG. 6-B

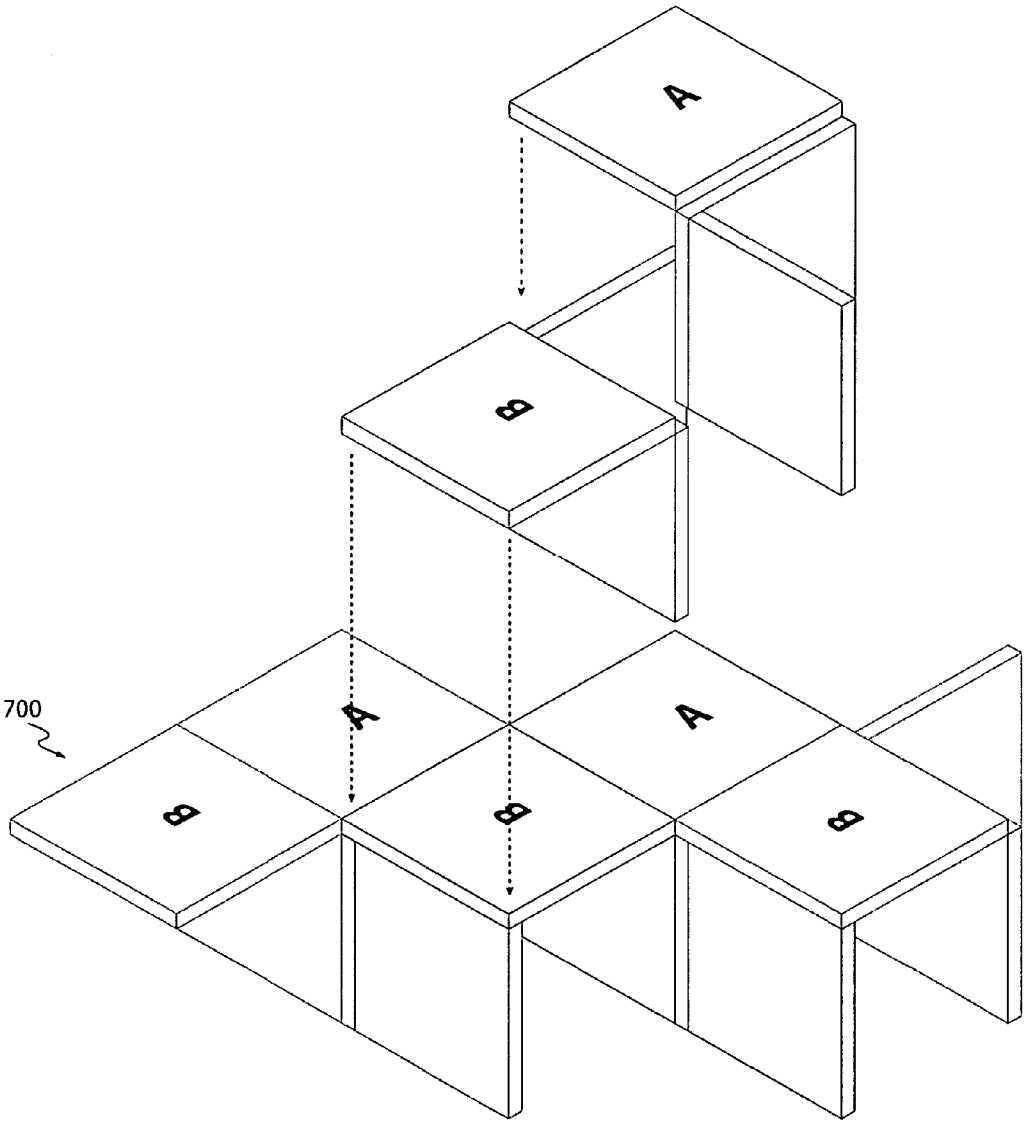
FIG. 7-A

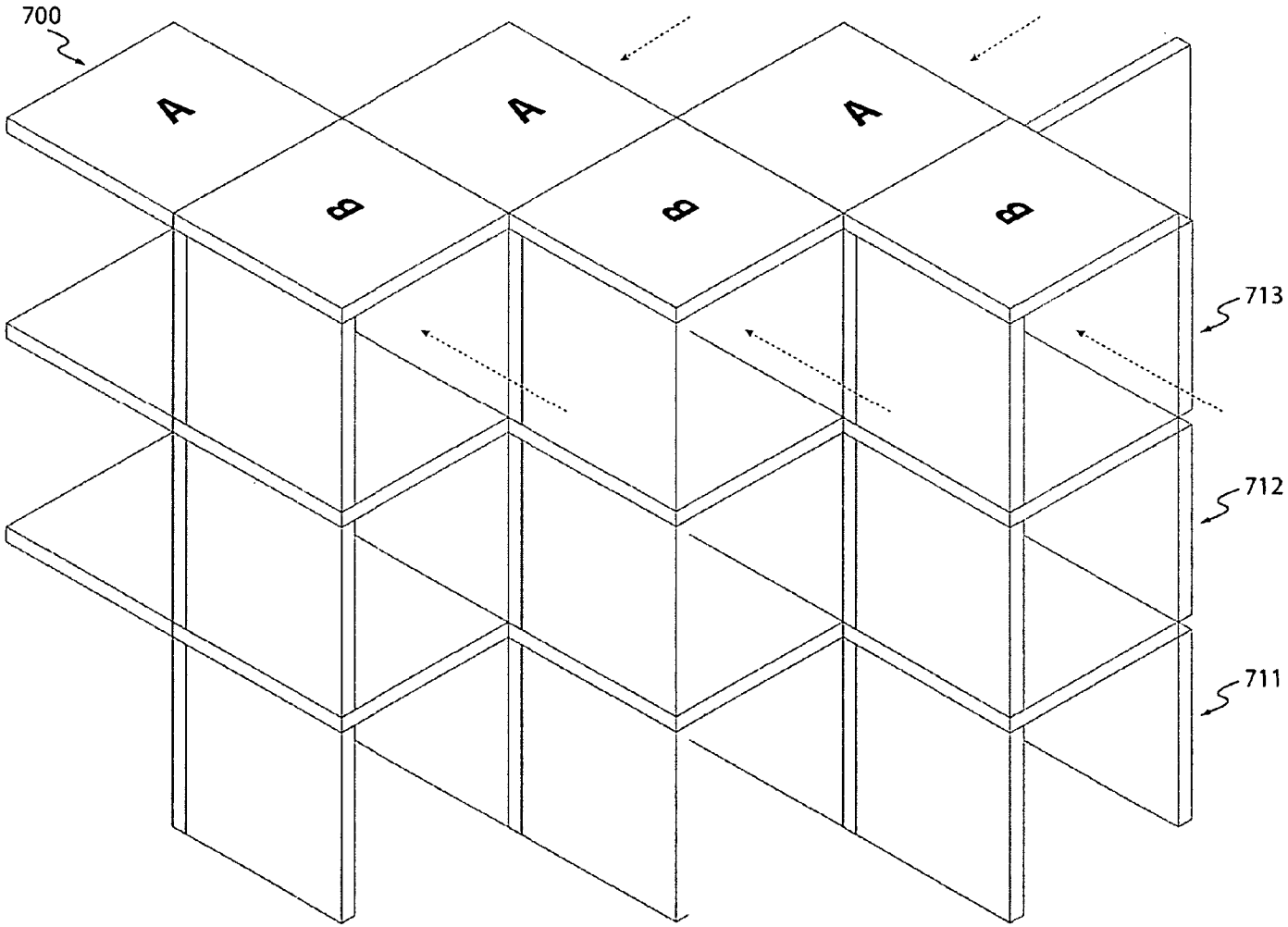
FIG. 7-B

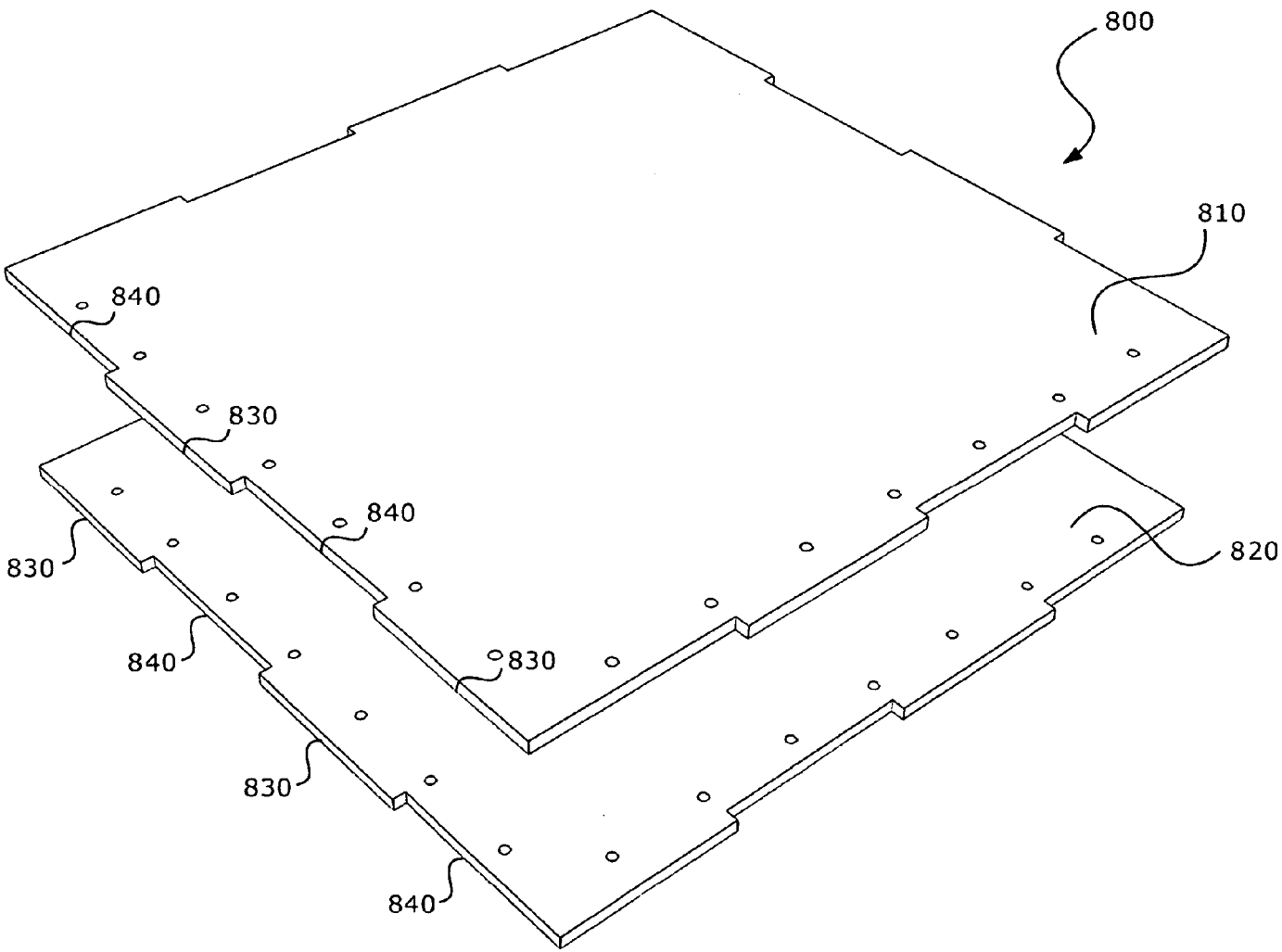
FIG. 8-A

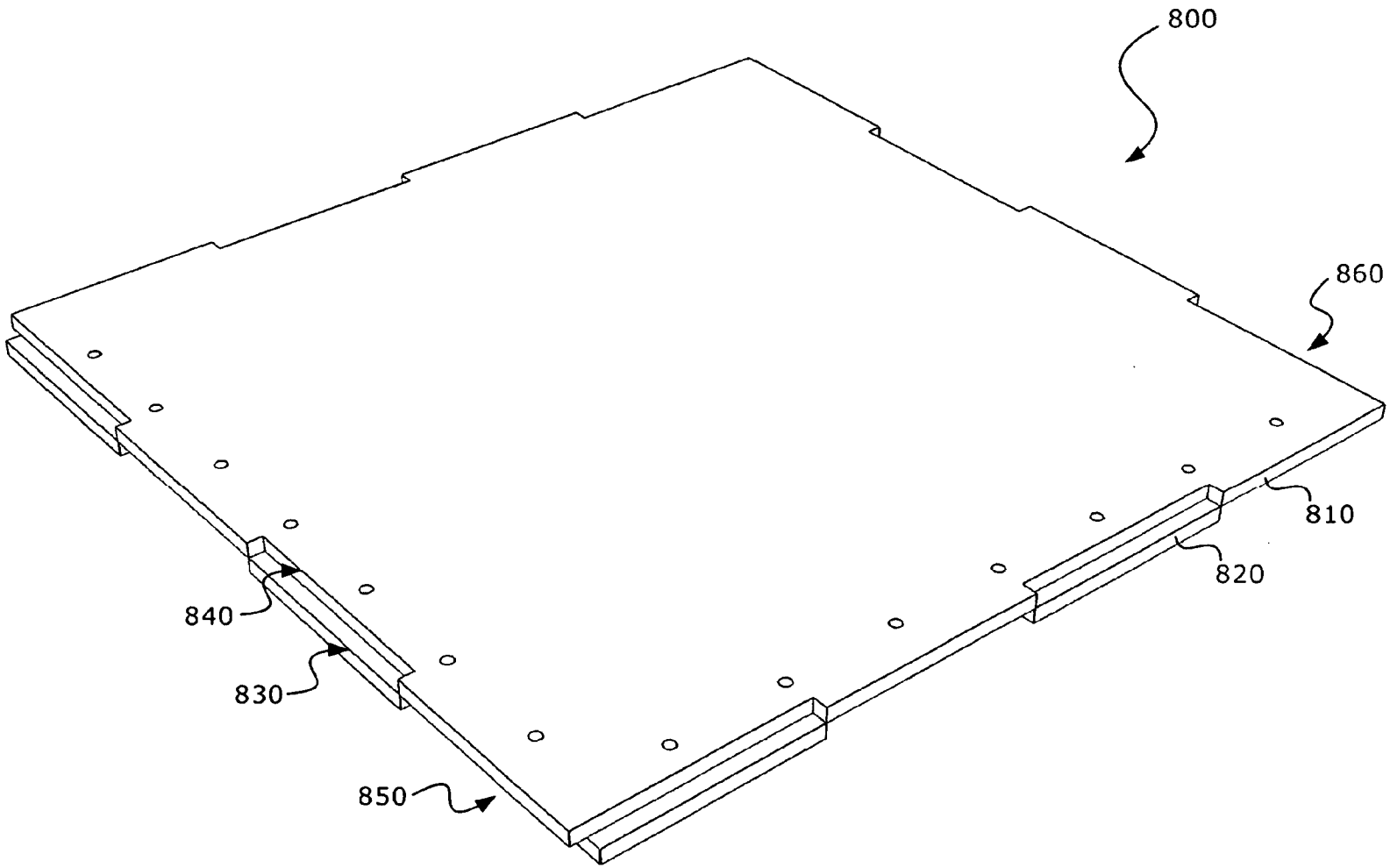
FIG. 8-B

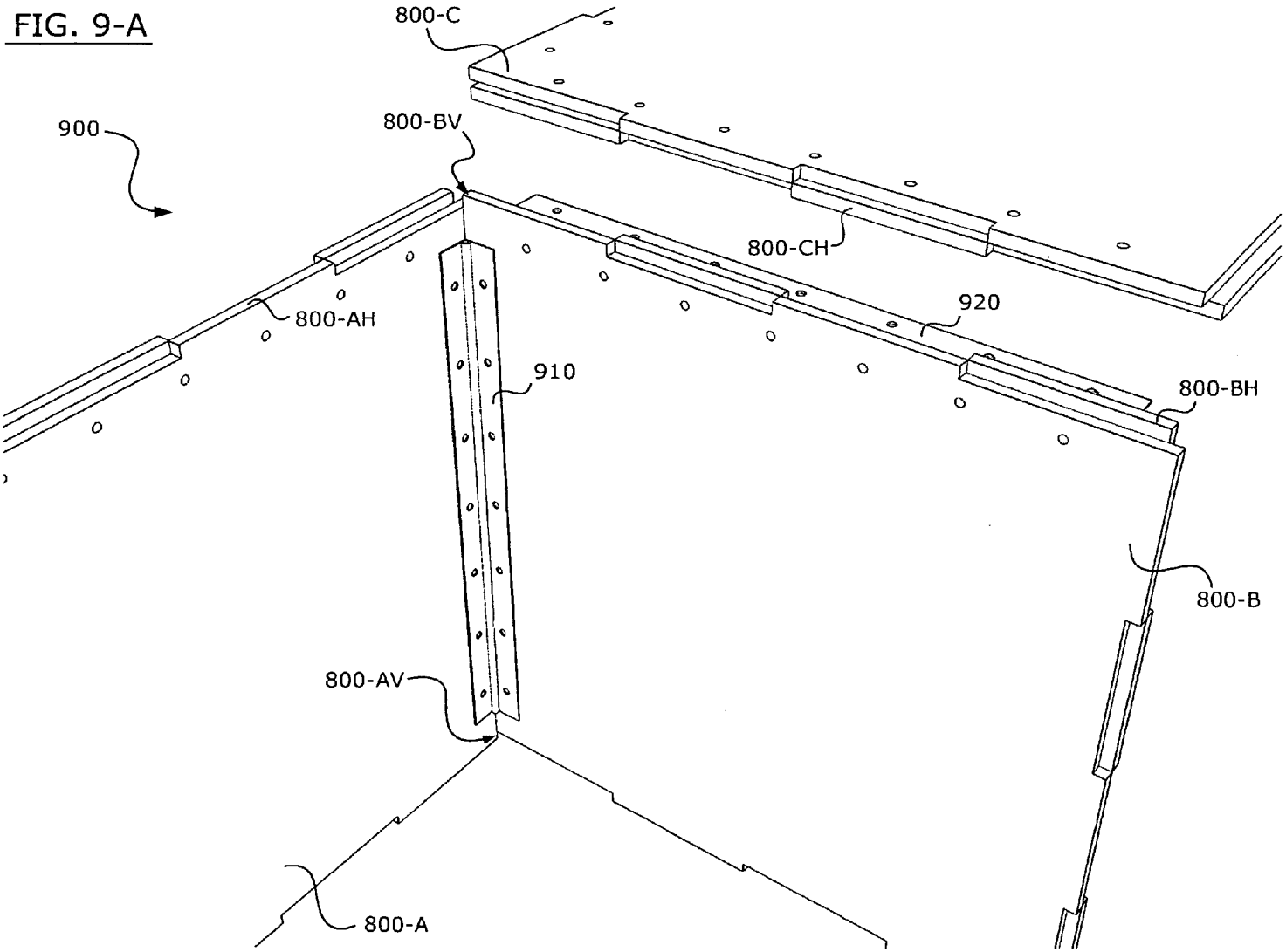
FIG. 9-A

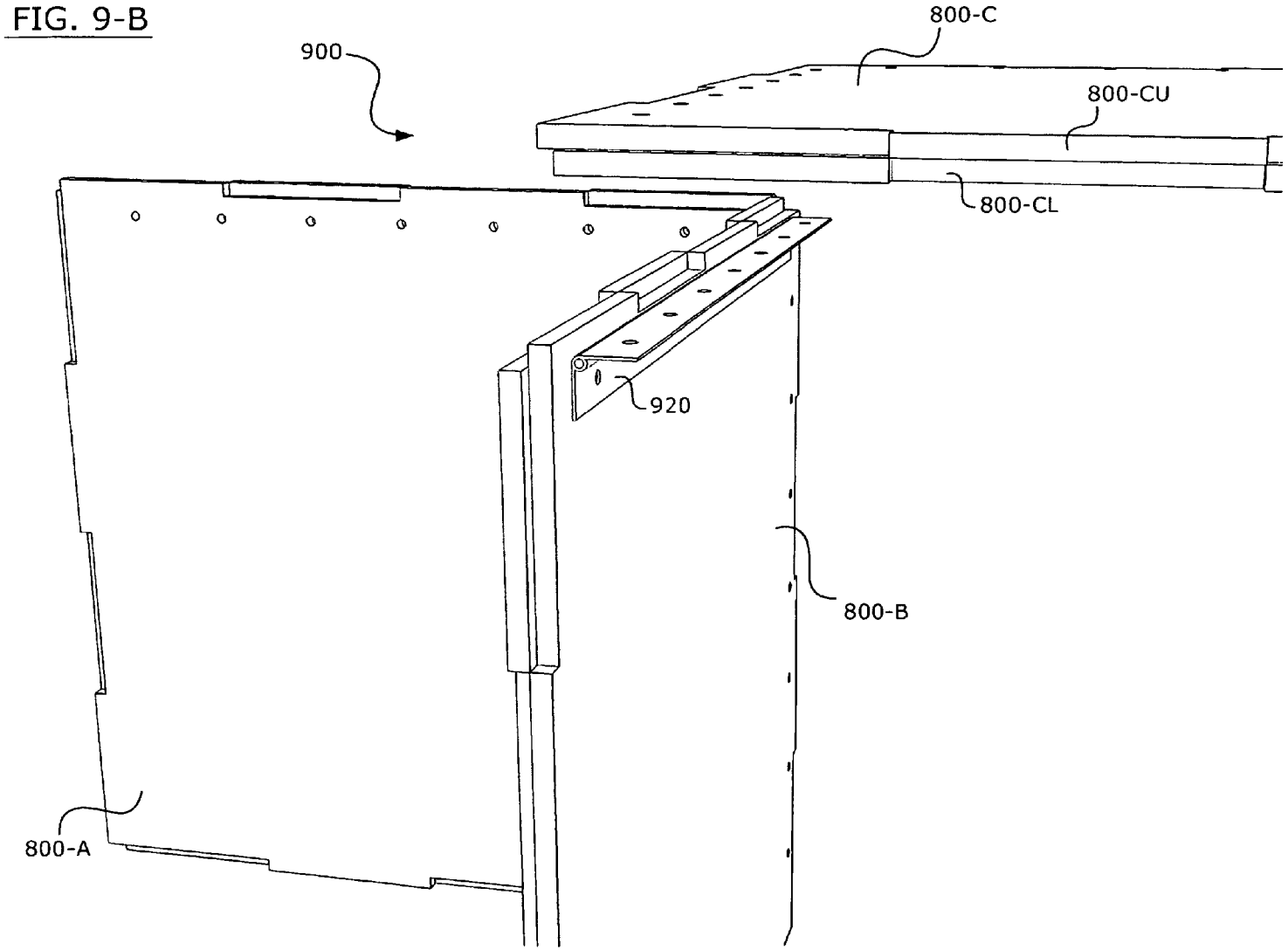
FIG. 9-B

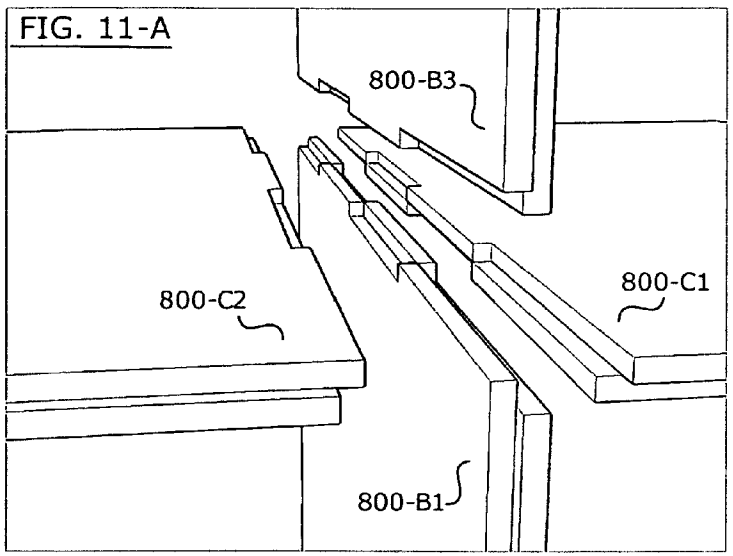
FIG. 11-A
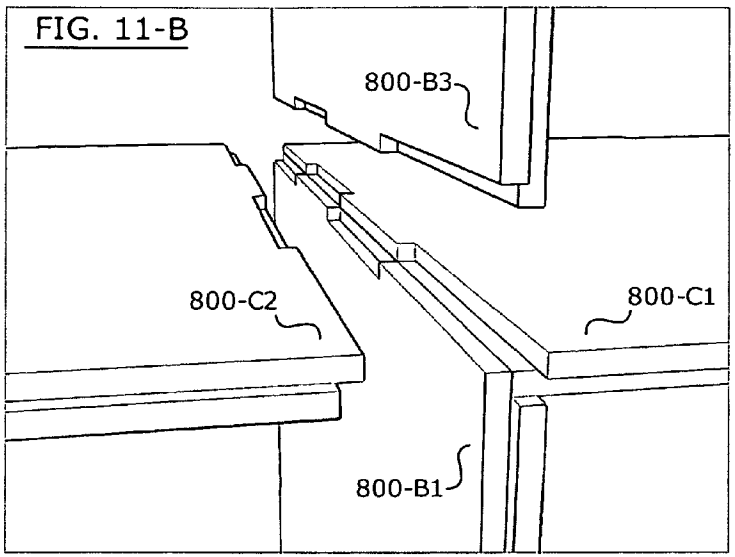
FIG. 11-B
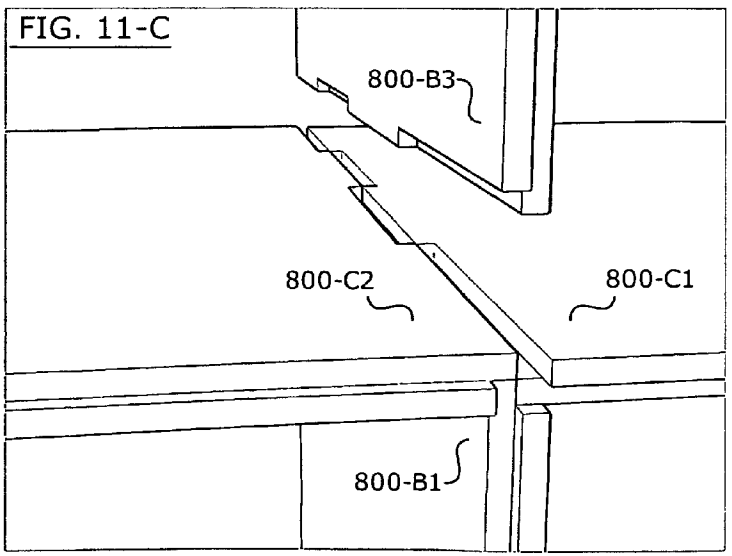
FIG. 11-C
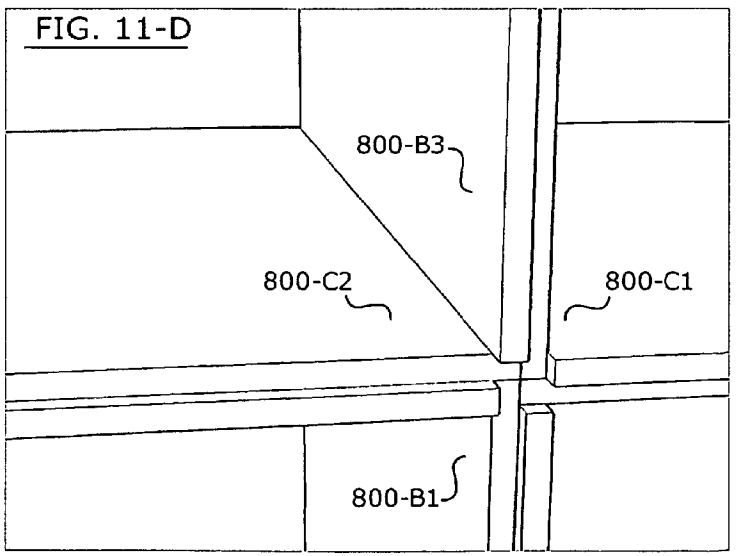
FIG. 11-D

MODULAR SYSTEM FOR CONSTRUCTING PLATFORM AND SHELVING STRUCTURES

CROSS REFERENCE TO RELATED-APPLICATION

This application is a continuation-in-part, and claims the benefit thereof under 35 U.S.C. §120, of U.S. application Ser. No. 11/233,336, filed Sep. 22, 2005.

TECHNICAL FIELD OF THE INVENTION

The present invention is directed, in general, to collapsible structures and, more specifically, to collapsible platform and shelving structures.

BACKGROUND OF THE INVENTION

Portable stages, or platforms, are often used in schools, hotels, convention centers, and other institutions wherein multiple use facilities require the capability of setting up a temporary stage. Such stages are generally made up of a number of individual sections which are positioned adjacent each other to make an extended stage surface of whatever size is required. When not in use, the individual sections may be folded to compact dimensions, then set aside for storage. Similarly, collapsible shelving which is easily and quickly assembled and disassembled is often used at trade shows, street vending, temporary retail displays and numerous other situations.

There are many prior art collapsible platform and shelving structures, but they are often designed to be used in only one or a few configurations. Structures designed for portable platforms are not readily used for collapsible shelving, and vice versa. Furthermore, such prior art structures often include complex supporting members that prevent the structure from being stored in a compact form. Also, when used in some environments, such as concert halls and music studios, the platforms can be subject to undesirable audible acoustic vibrations.

Accordingly, what is needed in the art is a new and improved system for constructing platform and shelving structures. Preferably, the system should be modular, and should allow for both platform and shelving structures to be constructed from similar modules. Furthermore, the system modules should be stowable in substantially the minimum possible space, and should be resistant to acoustic vibrations.

SUMMARY OF THE INVENTION

To address the above-discussed deficiencies of the prior art, the present invention provides a modular system for constructing platform and shelving structures. Each module is configurable in either a stowable or assembled configuration. In the assembled configuration, a module has a central vertical member having a horizontal top edge and a vertical edge, and a second vertical member having a horizontal top edge and a vertical edge. A first hinge member couples the vertical edge of the central vertical member proximate to the vertical edge of the second vertical member, wherein the second vertical member extends substantially perpendicular to a first side of the central vertical member, and wherein the top horizontal edge of the second vertical member is substantially within the same plane as the top horizontal edge of the central vertical member. A horizontal member having a horizontal edge is coupled by a second hinge member to the top horizontal edge of the central vertical member, wherein the horizontal member extends substantially perpendicular to a second side of the central vertical member, and wherein a bottom surface of the horizontal member is substantially parallel to the plane containing the top horizontal edges of the central and second vertical members. The module is configurable to a stowable configuration by rotating the second vertical member and the horizontal member about their hinged edges toward the central vertical member until the second vertical member and the horizontal member are substantially parallel and adjacent to the central vertical member, whereby a plurality of modules in the stowable configuration can be stored in substantially the minimum possible space.

In one embodiment, at least one of the central vertical member, the second vertical member and the horizontal member includes one or more key portions adapted to interlock with a member of an adjacent module when in the assembled configuration. The key portions can, for example, include tab portions and/or recess portions.

In an exemplary embodiment, at least one of the central vertical member, the second vertical member and the horizontal member comprise first and second sub-panels mated face-to-face. The first and second sub-panels can have substantially identical edge profiles, which can include tab and recess portions. In such embodiments, one of the first and second sub-panels is rotated or flipped with respect to the other sub-panel prior to being mated face-to-face, whereby the substantially identical edge profiles form complementary adjacent tab and recess portions.

The first and second hinge members can be, for example, continuous hinges. The hinge members can be coupled to the central vertical member, the second vertical member and the horizontal member by rivets through holes therein. Alternatively, the hinge members can be formed integral to the members.

In certain embodiments, at least one of the central vertical member, the second vertical member and the horizontal member are fashioned from an acoustical-dampening material. In such embodiments, the central vertical member and the second vertical member can have different acoustical impedances; the central vertical member and the horizontal member can have different acoustical impedances; and/or the second vertical member and the horizontal member can have different acoustical impedances. In a related embodiment, at least one of the central vertical member, the second vertical member and the horizontal member comprise a peripheral frame member; an internal panel can be coupled within the peripheral frame member. In this embodiment, the internal panel and the peripheral frame member can be fashioned from materials having different acoustical impedances. These embodiments are particularly advantageous for use in music environments.

The foregoing has outlined, rather broadly, the principles of the present invention so that those skilled in the art may better understand the detailed description of the exemplary embodiments that follow. Those skilled in the art should appreciate that they can readily use the disclosed conception and exemplary embodiments as a basis for designing or modifying other structures and methods for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the invention, reference is now made to the following detailed description taken in conjunction with the accompanying drawings, in which:

FIG. 2-A illustrates a profile view of two panels of an exemplary module in an assembled configuration;

FIG. 2-B illustrates an overhead view of two panels of an exemplary module in an assembled configuration;

FIG. 2-C illustrates a profile view of an exemplary module in a stowable configuration;

FIG. 4-A illustrates a profile view of joint members for joining two panels of adjacent modules;

FIG. 4-B illustrates an overhead view of joint members for joining two panels of adjacent modules;

FIG. 5-B illustrates a second exemplary platform structure constructed using modules in accordance with the principles of the invention;

FIG. 5-C illustrates a first exemplary shelving structure constructed using modules in accordance with the principles of the invention;

FIG. 6-A illustrates a third exemplary platform structure constructed using modules in accordance with the principles of the invention;

FIG. 6-B illustrates a second exemplary shelving structure constructed using modules in accordance with the principles of the invention;

FIG. 7-A illustrates a fourth exemplary platform structure constructed using modules in accordance with the principles of the invention;

FIG. 7-B illustrates a third exemplary shelving structure constructed using modules in accordance with the principles of the invention;

FIG. 8-A illustrates an exploded view of an exemplary member structure comprising sub-panels;

FIG. 8-B illustrates an assembled view of the exemplary member structure comprising sub-panels;

FIG. 9-A illustrates a first partially-assembled view of a module using the exemplary member structures formed from sub-panels;

FIG. 9-B illustrates a second partially-assembled view of a module using the exemplary member structures formed from sub-panels;

DETAILED DESCRIPTION

Figure 1:
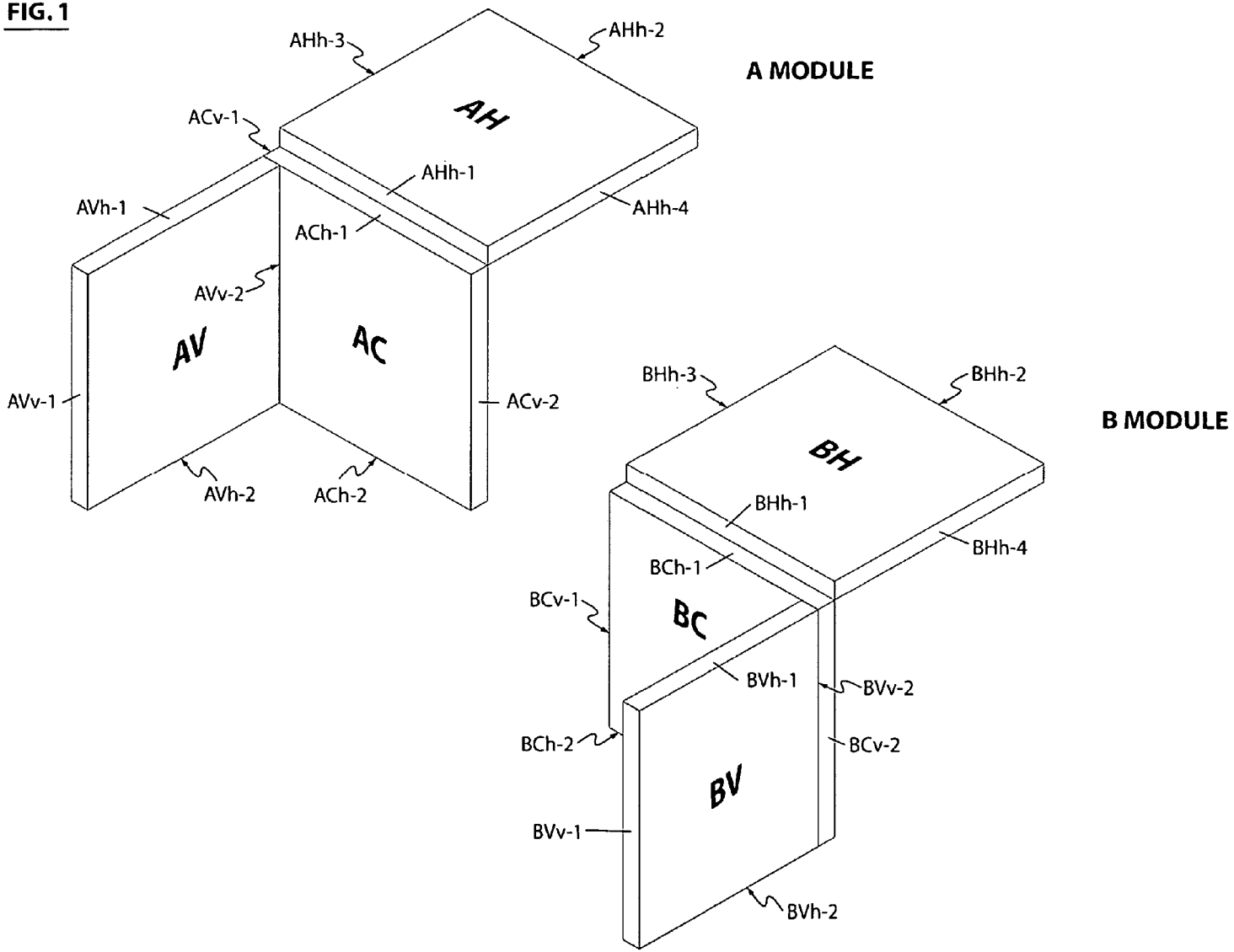
FIG. 1 illustrates first exemplary modules, in accordance with the principles of the invention, in an assembled configuration.

Referring to FIG. 1, illustrated are exemplary "A" and "B" modules for constructing platform and shelving structures; the modules are illustrated in an assembled configuration. In the following description, references in parentheses preceeding a semicolon refer specifically to "A" modules, and references in parentheses following a semicolon refer specifically to "B" modules. In general, each module has a central vertical member (AC; BC) hingedly-coupled to a second vertical member (AV; BV) extending perpendicular to a first side of the central vertical member, and a horizontal member (AH; BH) hingedly-coupled to the central vertical member and extending perpendicular to a second side of the central vertical member. As illustrated and described hereinafter with respect to FIGS. 4-7, the upper edges of the central vertical member and the second vertical member of a first module provide support to a horizontal member of a second module, whereby various structures can be formed from a plurality of modules. Each module is easily stowable by rotating the second vertical member and the horizontal member about their hinged edges toward the central vertical member until they are substantially parallel and adjacent thereto, whereby a plurality of modules in the stowable configuration can be stored in substantially the minimum possible space. In the exemplary embodiments illustrated and described, the central vertical member, second vertical member and horizontal member are solid panels; the principles of the invention, however, are not limited to such embodiments.

In the exemplary embodiment illustrated in FIG. 1, each module in the assembled configuration includes a central vertical rectangular panel (AC; BC) having parallel top and bottom horizontal edges (ACh-1, ACh-2; BCh-1, BCh-2) and parallel first and second vertical edges (ACv-1, ACv-2; BCv-1, BCv-2). A second vertical rectangular panel (AV; BV), having parallel top and bottom horizontal edges (AVh-1, AVh-2; BVh-1, BVh-2) and parallel first and second vertical edges (AVv-1, AVv-2; BVv-1, BVv-2), is coupled by a first hinge member (not shown; see FIG. 2-B) to the central vertical rectangular panel. For "A" modules, the second vertical edge (AVv-2) of the second vertical rectangular panel (AV) is coupled proximate to the first vertical edge (ACv-1) of the central vertical rectangular panel (AC); for "B" modules, the second vertical edge (BVv-2) of the second vertical rectangular panel (BV) is coupled proximate to the second vertical edge (BCv-2) of the central vertical rectangular panel (BC). In the assembled configuration, the second vertical rectangular panel (AV; BV) extends substantially perpendicular to a first side of the central vertical rectangular panel (AC; BC), and the top horizontal edge (AVh-1; BVh-1) of the second vertical rectangular panel (AV; BV) is substantially within the same plane as the top horizontal edge (ACh-1; BCh-1) of the central vertical rectangular panel (AC; BC). Finally, each "A" and "B" module includes a horizontal rectangular panel (AH; BH) having parallel first and second horizontal edges (AHh-1, AHh-2; BHh-1, BHh-2) and parallel third and fourth horizontal edges (AHh-3, AHh-4; BHh-3, BHh-4) perpendicular to the first and second horizontal edges. A second hinge member (not shown; see FIG. 2-A) couples the first horizontal edge (AHh-1; BHh-1) of the horizontal rectangular panel (AH; BH) proximate to the top horizontal edge (ACh-1; BCh-1) of the central vertical rectangular panel (AC; BC). In the assembled configuration, the horizontal rectangular panel (AH; BH) extends substantially perpendicular to a second side of the central vertical rectangular panel (AC; BC); a top surface of the horizontal rectangular panel (AH; BH) is substantially parallel to the plane containing the top horizontal edges (ACh-1, AVh-1; BCh-1, BVh-1) of the central and second vertical panels. As illustrated and described hereinafter with respect to FIGS. 4-7, the upper edges (ACh-1, AVh-1; BCh-1, BVh-1) of the central vertical member (AC; BC) and the second vertical member (AV; BV) of a first "A" or "B" module can provide support to a horizontal panel (AH; BH) of a second "A" or "B" module, whereby various platform and shelving structures can be formed from a plurality of modules.

Turning now, to FIG. 2-A, illustrated is a profile view of central vertical panel AC and horizontal rectangular panel AH of exemplary "A" module in the assembled configuration (a similar profile view is applicable to panels BC and BH of exemplary "B" module). In this embodiment, hinge member H-2 couples a bottom face of horizontal rectangular panel AH, proximate to edge AHh-1, in the same plane as top horizontal edge ACh-1 of central vertical panel AC. Similarly, FIG. 2-B illustrates an overhead view of panels AC and AV of exemplary "A" module in an assembled configuration (a similar profile view is applicable to panels BC and BV of exemplary "B" module). In this embodiment, hinge member H-1 couples second vertical rectangular panel AV to central vertical panel AC such that its outer face lies in the same plane as the vertical edge ACv-1 of central vertical panel AC (or vertical edge BCv-2 of central vertical panel BC for "B" modules).

As illustrated by the arrows in FIGS. 2-A and 2-B, the horizontal rectangular panels (AH; BH) and second vertical rectangular panels (AV; BV) of each "A" or "B" module can be rotated about hinges H-1 and H-2 toward the central vertical rectangular panel (AC; BC) until they are substantially parallel and adjacent thereto, as illustrated in FIG. 2-C. As can be seen in FIG. 2-C, the three panels of each module are folded into the most compact area, whereby a plurality of modules in the stowable configuration can be stored in substantially the minimum possible space. Although not illustrated in FIG. 2-C, those skilled in the art will recognize that spacing elements can be included on one or more of the faces of each panel opposite to the hinged edges to compensate for the thickness of hinges H-1 and H-2, whereby the panels will be parallel in the stowable configuration, thus ensuring that a stack of stored modules will be stable. Hinge members H-1 and H-2 can be, for example, continuous, or "piano," hinges. In alternate embodiments, several hinges can be used at either end of the panels, or other flexible materials having suitable strength and flexibility can be used to couple the panels in a manner that allows them to be configured in the assembled or stowable configuration.

Figure 3:
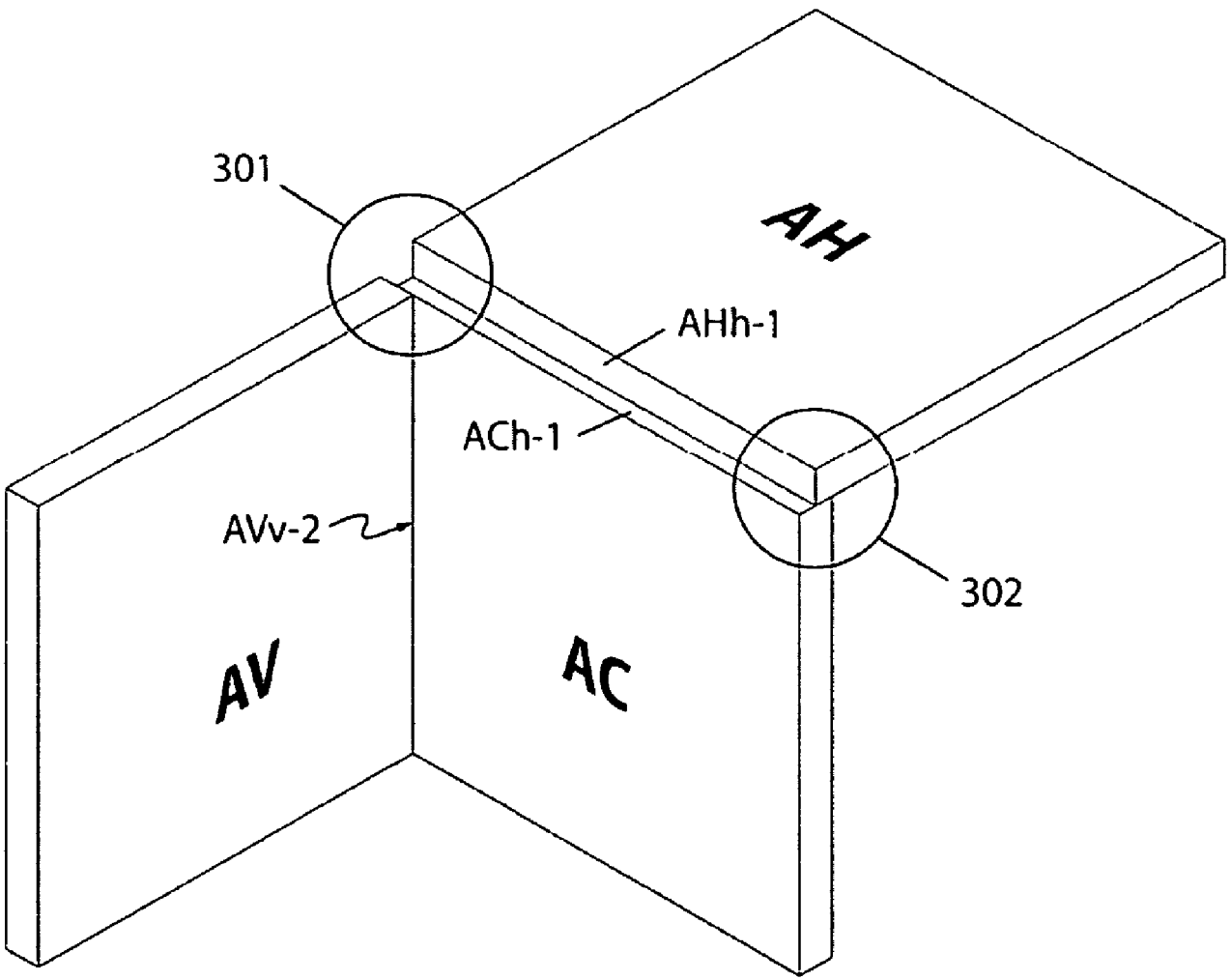
FIG. 3 illustrates a second exemplary module, in accordance with the principles of the invention, in an assembled configuration.

Turning now to FIG. 3, illustrated is a second exemplary "A" module in an assembled configuration (a similar view is applicable to "B" modules). As highlighted by viewpoints 301 and 302, it can be seen that the second vertical rectangular panel AV and horizontal rectangular panel AH are offset from the central vertical rectangular panel AC. In this embodiment, in contrast to the embodiment illustrated in FIG. 2-A, edge AHh-1 of horizontal rectangular panel AH does not lie in the same plane as the face of central vertical panel AC to which it is hingedly-coupled; rather, edge AHh-1 is offset therefrom and lies over edge ACh-1 of central vertical panel AC. Similarly, in contrast to the embodiment illustrated in FIG. 2-B, the outer face of second vertical rectangular panel AV does not lie in the same plane as edge ACv-1 of central vertical panel AC to which it is hingedly-coupled. Those skilled in the art will recognize that such variations in the relative positions at which the panels are hingedly-coupled can be utilized to advantage for modules designed specifically for certain structures. Similarly, it will be recognized that although the exemplary embodiment illustrated is constructed from substantially solid square panels of identical relative dimensions, one or more of the panels can, if desired, be non-solid and have other shapes. For example, panels AC and AV can be metal frames, while panel AH is a solid wood plank. Such alternative constructions can provide access within or through a structure for routing electrical cables.

Turning now to FIGS. 4-A and 4-B, illustrated are a profile view and overhead view of optional joint members for joining two panels of adjacent modules. In the exemplary embodiments illustrated, at least a portion of a panel of a first module, and a portion of a panel of a second module, include tongue and groove members, wherein a tongue member associated with the horizontal rectangular panel or the central or second vertical rectangular panels of one module is insertable into a groove member associated with the horizontal rectangular panel or the central or second vertical rectangular panels of another module. For example, as shown in FIG. 4-A, a tongue 402 disposed on the bottom face of horizontal panel AH(2) proximate to edge AHh-2 can be inserted in a groove 401 disposed within edge ACh-1 of central vertical panel AC(1). Similarly, as shown in the overhead view in FIG. 4-B, a tongue 403 disposed on edge AVv-1 of a second vertical panel AV(1) of a first "A" module can be inserted in a groove 404 disposed proximate edge ACv-2 on the face of central vertical panel AC(2) of a second "A" module. Although sample modules without such tongue and groove elements have been used satisfactorily to construct elevated platforms, those skilled in the art will recognize the advantage of using integral means to secure adjacent modules in certain applications. In addition, or as an alternative, other means can be used to securely couple adjacent modules, such as Velcro® tabs or snap fittings.

Figure 5A:
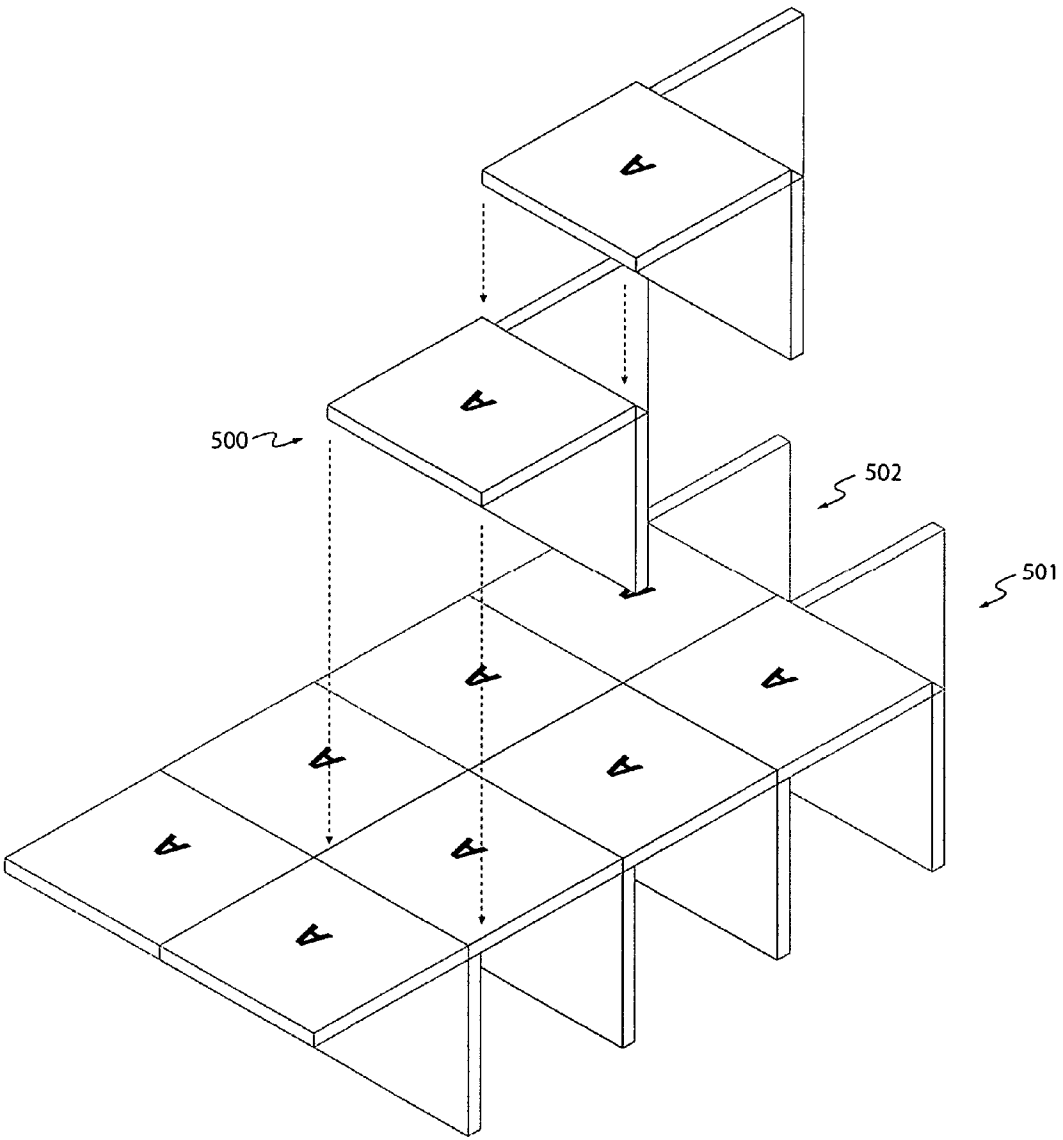
FIG. 5-A illustrates a first exemplary platform structure constructed using modules in accordance with the principles of the invention.

Having described the essential and optional features of exemplary "A" and "B" modules, various exemplary platform and shelving structures will now be described. Referring to FIG. 5-A, illustrated is a first exemplary platform structure 500 constructed using "A" modules in accordance with the principles of the invention (a similar structure can be constructed from "B" modules). As can be seen, platform structure 500 is constructed from two rows 501, 502 of "A" modules coupled in series, wherein the central vertical rectangular panels of each module in a row are parallel to each other. The horizontal rectangular panel of each module is supported by the top horizontal edges of the central and second vertical panels of an adjacent module—except for a module at one end of each row (the horizontal panel for such end module can be left folded against the central vertical panel). For the platform structure 500, all modules are coupled within a single plane, wherein at least one edge of each horizontal rectangular panel of each module abuts an edge of a horizontal rectangular panel of an adjacent module, whereby the horizontal rectangular panels of all modules define an elevated platform. FIG. 5-B illustrates a similar platform structure 505 constructed using both "A" and "B" modules in accordance with the principles of the invention. Platform structure 505 is constructed from a row of "A" modules adjacent to a row of "B" modules (further additional alternating rows can be used to extend the platform). Within each row, the "A" or "B" modules are coupled in series, wherein the central vertical rectangular panels of each module in a row are parallel to each other. At the end of a row, a module of the opposite type to be used in the next adjacent row is positioned orthogonally to the last module in the row.

Utilizing similar construction to that illustrated in FIG. 5-A, FIG. 5-C illustrates a first exemplary shelving structure 510 constructed using "A" modules in accordance with the principles of the invention (a similar structure can be constructed from "B" modules). For shelving structure 510, a first group of modules 511 are coupled within a first horizontal plane and a second group of modules 512 are coupled within a second horizontal plane, the second group being supported by the first group (additional groups of modules, such as group 513, can be added as desired). The groups of modules (511, 512, 513) define a vertical structure having a plurality of openings (generally designated by directional arrows into structure) between adjacent ones of the vertical rectangular panels and horizontal panels, wherein the openings define a plurality of shelves in the vertical structure.

FIG. 6-A illustrates a second exemplary platform structure 600 constructed using "A" modules in accordance with the principles of the invention (a similar structure can be constructed from "B" modules). Platform structure 600 is constructed from four "A" modules coupled orthogonally, wherein the central vertical rectangular panels of adjacent ones of the modules are perpendicular to each other. The horizontal rectangular panel of each module is supported by the top horizontal edges of the central and second vertical panels of an adjacent module. For the platform structure 600, all modules are coupled within a single plane, wherein at least one edge of each horizontal rectangular panel of each module abuts an edge of a horizontal rectangular panel of an adjacent module, whereby the horizontal rectangular panels of all modules define an elevated platform. To extend the size of platform structure 600, additional concentric rows of modules can be placed around the periphery of platform structure 600. Utilizing similar construction, FIG. 6-B illustrates a second exemplary shelving structure 610 constructed using "A" modules in accordance with the principles of the invention (a similar structure can be constructed from "B" modules). For shelving structure 610, a first group of modules 611 are coupled within a first horizontal plane and a second group of modules 612 are coupled within a second horizontal plane, the second group being supported by the first group (additional groups of modules, such as group 613, can be added as desired). The groups of modules (611, 612, 613) define a vertical structure having a plurality of openings (generally designated by directional arrows into structure), wherein the openings define a plurality of shelves in the vertical structure.

Finally, FIG. 7-A illustrates a third exemplary platform structure 700 constructed using "A" and "B" modules in accordance with the principles of the invention. Platform structure 700 is constructed from an alternating series of "A" and "B" modules coupled orthogonally, wherein the central vertical rectangular panels of adjacent modules are perpendicular to each other. The horizontal rectangular panel of each module is supported by the top horizontal edges of the central and second vertical panels of an adjacent module. For the platform structure 700, all modules are coupled within a single plane, wherein at least one edge of each horizontal rectangular panel of each module abuts an edge of a horizontal rectangular panel of an adjacent module, whereby the horizontal rectangular panels of all modules define an elevated platform. To extend the size of platform structure 700, additional adjacent rows of modules can be placed on either side of platform structure 700. Utilizing similar construction, FIG. 7-B illustrates a third exemplary shelving structure 710 constructed using "A" and "B" modules in accordance with the principles of the invention. For shelving structure 710, a first group of modules 711 are coupled within a first horizontal plane and a second group of modules 712 are coupled within a second horizontal plane, the second group being supported by the first group (additional groups of modules, such as group 713, can be added as desired). The groups of modules (711, 712, 713) define a vertical structure having a plurality of openings (generally designated by directional arrows into structure), wherein the openings define a plurality of shelves in the vertical structure.

The foregoing has described certain exemplary embodiments that illustrate the core principles of the invention. The following describes various alternatives, improvements and additional features that can be employed in the practice of the invention. First, turning to FIG. 8-A, illustrated is an exploded view of an exemplary member 800 comprising first and second sub-panels 810, 820. The first and second sub-panels 810, 820 can have substantially identical edge profiles, which can include tab and recess portions, generally designated 830 and 840, respectively. Although exemplary member 800 is illustrated as being formed from separate sub-panels, those skilled in the art will recognize that such a member can be integrally-formed using, for example, injection-molded plastic technologies.

Turning now FIG. 8-B, illustrated is an assembled view of the exemplary member 800 comprising sub-panels 810, 820. As can be seen in this figure, one of the first and second sub-panels (810, 820) is rotated or flipped with respect to the other sub-panel (820, 810) prior to being mated face-to-face, whereby the substantially identical edge profiles form complementary adjacent tab and recess portions (830, 840). The complementary adjacent tab and recess portions form key portions adapted to interlock with a member of an adjacent module when in the assembled configuration. As will be described hereinafter with respect to FIG. 11, the edges of each member 800 can interlock with other members, perpendicular thereto, of the same or an adjacent module. Each member 800 can interlock not only on all four edges simultaneously, but also on both the top and bottom surfaces of each edge; i.e., each member can simultaneously interlock with eight other members perpendicular thereto.

In the exemplary embodiments illustrated herein, each module is formed from a central vertical member, second vertical member and horizontal member having substantially identical dimensions. The dimensions of the exemplary member 800, however, can be varied with respect to different members of the same module. This feature allows for the construction of unique structures formed from modules having the same dimensions for each module member, modules having different dimensions for each module member, or a variety of modules of uniform and non-uniform dimensions for each module member. Variations in the dimensions of module members can also allow for the key portions of the edge of a member to interlock with an adjacent member edge-to-edge. For example, if exemplary member 800 is used for horizontal members of adjacent modules, its dimension perpendicular to the central vertical member can be made slightly longer than the dimension of the second vertical member perpendicular to the central vertical member, whereby the horizontal member of a first module can interlock with a complementary key portion of a horizontal member of an adjacent, second module. Thus, according to these interlocking features of the invention, adjacent modules can be interlocked to provide greater structural rigidity.

Turning now to FIG. 9-A, illustrated is a first partially-assembled view of a module 900 using exemplary member 800 for the second vertical member 800-A, central vertical member 800-B and horizontal member 800-C. In an assembled configuration, the module 900 includes central vertical member 800-B having a horizontal top edge 800-BH and a vertical edge 800-BV, and a second vertical member 800-A having a horizontal top edge 800-AH and a vertical edge 800-AV. A first hinge member 910 couples the vertical edge 800-BV of the central vertical member 800-B proximate to the vertical edge 800-AV of the second vertical member 800-A, wherein the second vertical member 800-A extends substantially perpendicular to a first side of the central vertical member 800-B, and wherein the top horizontal edge 800-AH of the second vertical member 800-A is substantially within the same plane as the top horizontal edge 800-BH of the central vertical member 800-B. A horizontal member 800-C having a horizontal edge 800-CH is coupled by a second hinge member 920 to the top horizontal edge 800-BH of the central vertical member 800-B, wherein the horizontal member 800-C extends substantially perpendicular to a second side of the central vertical member 800-B, and wherein a bottom surface of the horizontal member is substantially parallel to the plane containing the top horizontal edges of the central and second vertical members. The module 900 is configurable to a stowable configuration by rotating the second vertical member 800-A and the horizontal member 800-C about their hinged edges toward the central vertical member 800-B until the second vertical member and the horizontal member are substantially parallel and adjacent to the central vertical member, whereby a plurality of modules in the stowable configuration can be stored in substantially the minimum possible space. The first and second hinge members 910, 920 can be, for example, continuous hinges. The hinge members can be coupled to the central vertical member 800-B, the second vertical member 800-A and the horizontal member 800-C by rivets (not shown) through holes in the hinge members and members. Alternatively, screws, bolts or adhesive means can be used to join the hinge members to the members. In an alternate embodiment, the hinge members are integrally-formed with the members using, for example, injection-molded plastic technologies.

FIG. 9-B illustrates a second partially-assembled view of module 900. In this view, those skilled in the art will recognize that hinge 920 can be positioned such that, when in the assembled configuration (i.e., non-stowed configuration), the tabs and recesses of the hinged edge of the lower panel portion 800-CU of member 800-C will interlock with the complementary tabs and recesses of the hinged edge of the central vertical member 800-B as the horizontal member 800-C is rotated into a position perpendicular to central vertical member 800-B. The tabs and recesses of the hinged edge of the upper panel portion 800-CU are also then in a position to interlock with complementary tabs and recesses of the horizontal member of an adjacent module. Thus, key portions of member edges can interlock with both key portions of adjacent members to which they are hingedly-coupled and to key portions of members of adjacent modules.

Figure 10:
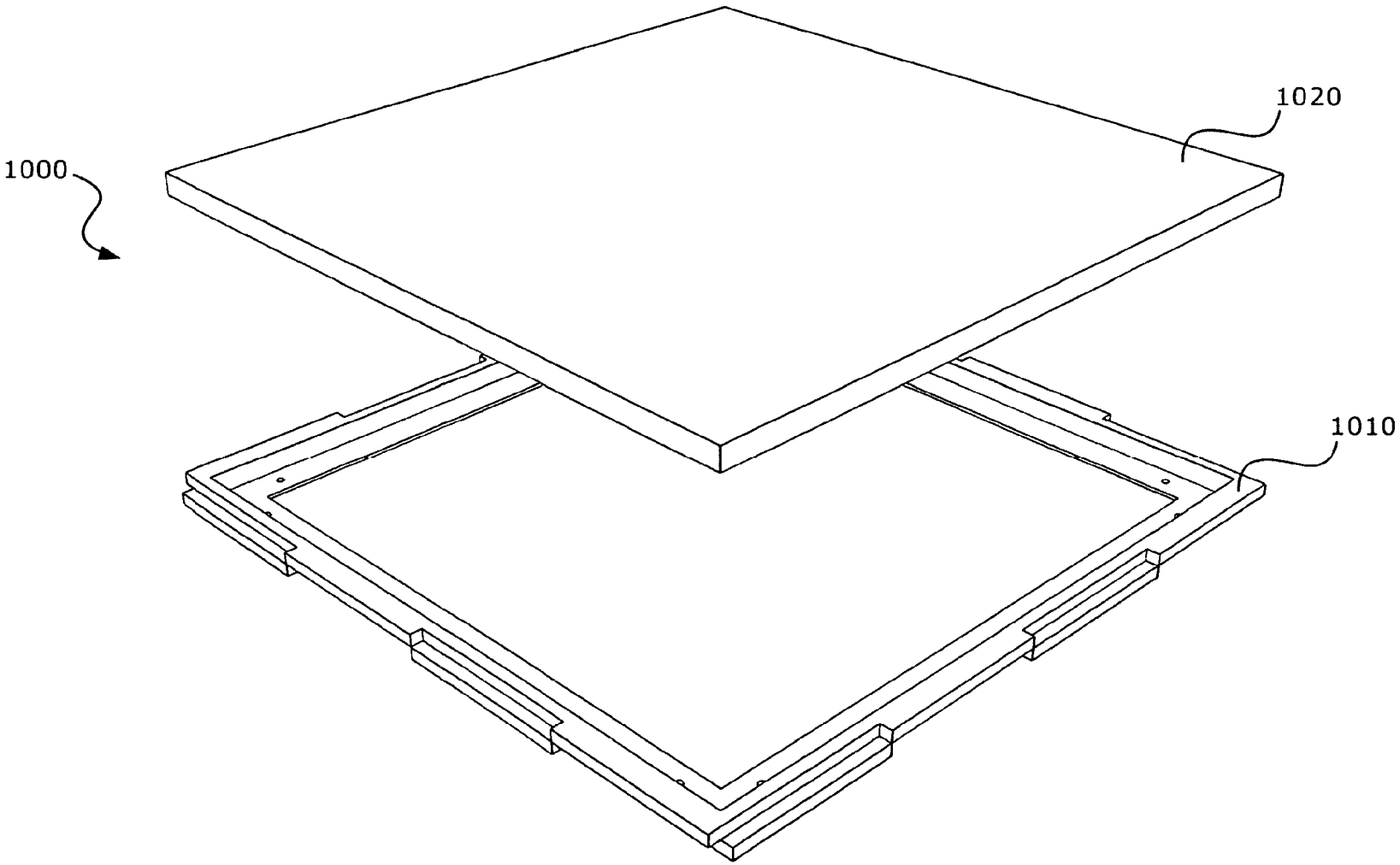
FIG. 10 illustrates an exploded view of an exemplary member structure comprising a peripheral frame member and an optional internal panel; and, FIGS. 11-A, 11-B, 11-C and 11-D illustrate the interlocking of exemplary member structures of a plurality of modules.

Turning now to FIG. 10, illustrated is an exploded view of an exemplary member 1000 comprising a peripheral frame member 1010 and an optional internal panel 1020. In this embodiment, the peripheral frame member is characterized by an outer edge having key portions similar to those described hereinabove. Rather than being a solid panel as described supra, however, the center of the "panel" has an opening. For a platform structure, the opening of a horizontal member should be fitted with an internal panel 1020 in order to provide support for objects or persons on top of the platform; the internal panel 1020 can be solid or, if desired, a structural mesh. If desired, the opening of central vertical members and second vertical members can also include an internal panel 1020.

In certain environments, such as concert halls and music recording studios, platforms such as described herein are often used to elevate the percussionists and their instruments; so-called "drum risers." Conventional drum risers are basically a box that vibrates sympathetically with the noise from other instruments—most notably the bass guitar—which can be picked up by microphones used for the drums, which can undesirably result in low-pitched "rumble" in the amplified signals. To overcome this problem, it is common to add mass to the drum riser by either using heavy wood or by adding extensive bracing to dampen the undesired acoustic vibrations.

To address this problem of undesired acoustic resonance, the present invention can be adapted to fashion one or more of the central vertical member, the second vertical member and the horizontal member from one or more acoustical-dampening materials. One simple approach is to construct adjacent members from materials have different acoustical impedances. As those skilled in the field of acoustics are aware, any time there is an acoustical-impedance mismatch between adjacent materials, the junction functions to attenuate the transmission of vibrations. Even if identical wood, for example, is used for each member, an acoustic mismatch can be realized by aligning the wood grain of adjacent members perpendicular to one another. Thus, in such embodiments, it can be desirable that the central vertical member and the second vertical member have different acoustical impedances; the central vertical member and the horizontal member have different acoustical impedances; and/or the second vertical member and the horizontal member have different acoustical impedances. The techniques for sound dampening are also readily applicable to exemplary member 1000.

In embodiments using exemplary member 1000, the internal panel 1020 and the peripheral frame member 1010 can be fashioned from materials having different acoustical impedances. For example, the peripheral frame member 1020 can be injection molded from plastic, with an internal panel 1020 formed from wood or a synthetic or composite material. The internal panel 1020 can also be formed from wooden subpanels with the grains of each aligned perpendicular to the other in order to provide improved sound-dampening. As noted supra, the horizontal members for modules designed for a platform structure are desirably solid. The internal panels 1020 for central vertical members and second vertical members, however, can include openings to allow air to more freely pass through the platform, thereby minimizing vibration resulting from sound waves. Finally, reference is made to FIGS. 11-A, 11-B, 11-C and 11-D, which illustrate the interlocking of the central vertical member 800-B1 and horizontal member 800-C1 of a first module (a hinge member used to couple these members is not illustrated) with the horizontal member 800-C2 of a second module and the central vertical member 800-B3 of a third module. FIG. 11-A illustrates the members before any are interlocked. FIG. 11-B illustrates the interlocking of central vertical member 800-B1 and horizontal member 800-C1; these members, when coupled by a hinge member, interlock as horizontal member 800-Cl is rotated to a position perpendicular to central vertical member 800-B1. In FIG. 11-C, the horizontal member 800-C2 of a second module is brought into position to interlock with the central vertical member 800-B1 of the first module. In FIG. 11-D, the central vertical member 800-B3 of a third module is brought into position to interlock with both the horizontal member 800-C1 of the first module and the horizontal member 800-C2 of the second module. Although not illustrated, similar interlocking relationships exist for each edge of each member 800. Thus, from these figures, those skilled in the art will recognize how each member 800 can interlock on all four edges simultaneously, on both the top and bottom surfaces; i.e., each panel can simultaneously interlock with eight other panels perpendicular thereto.

Although the present invention has been described in detail, those skilled in the art will conceive of various changes, substitutions and alterations to the exemplary embodiments described herein without departing from the spirit and scope of the invention in its broadest form. The exemplary embodiments presented herein illustrate the principles of the invention and are not intended to be exhaustive or to limit the invention to the form disclosed; it is intended that the scope of the invention be defined by the claims appended hereto, and their equivalents.

What is claimed is:

1. A modular system for constructing platform and shelving structures, said system comprising:

a plurality of modules, each module configurable in either a stowable or assembled configuration, each of said modules, in said assembled configuration, consisting essentially of:

a central vertical member having a horizontal top edge and a vertical edge, said edges defining opposing first and second vertical sides of said member;

a second vertical member having a horizontal top edge and a vertical edge;

a first hinge member coupling said vertical edge of said central vertical member proximate to said vertical edge of said second vertical member, wherein said second vertical member extends substantially perpendicular to said first vertical side of said central vertical member, and wherein said horizontal top edge of said second vertical member is substantially within the same plane as said horizontal top edge of said central vertical member;

a horizontal member having a horizontal edge; and, a second hinge member coupling said horizontal edge of said horizontal member proximate to said horizontal top edge of said central vertical member, wherein said horizontal member extends substantially perpendicular to said second vertical side of said central vertical member, and wherein a bottom surface of said horizontal member is substantially parallel to the plane containing said horizontal top edges of said central and second vertical members;

wherein each said module is configurable to said stowable configuration by rotating said second vertical member and said horizontal member about their hinged edges toward said central vertical member until said second vertical member and said horizontal member are substantially parallel and adjacent to said central vertical member, whereby a plurality of said modules in said stowable configuration can be stored in substantially the minimum possible space; and, wherein said plurality of modules comprises at least first and second modules and, when said first and second modules are configured in said assembled configuration, at least a portion of a bottom surface of said horizontal member of said first module is supported by said horizontal top edge of said central vertical member or said second vertical member of said second module.

2. The modular system recited in claim 1, wherein at least one of said central vertical member, said second vertical member and said horizontal member comprise key portions adapted to interlock with a member of an adjacent module when in said assembled configuration.

3. The modular system recited in claim 2, wherein at least one of said key portions comprises a tab portion.

4. The modular system recited in claim 2, wherein at least one of said key portions comprises a recess portion.

5. The modular system recited in claim 2, wherein at least one of said central vertical member, said second vertical member and said horizontal member comprise first and second sub-panels mated face-to-face.

6. The modular system recited in claim 5, wherein said first and second sub-panels have substantially identical edge profiles.

7. The modular system recited in claim 6, wherein said substantially identical edge profiles comprise tab and recess portions.

8. The modular system recited in claim 6, wherein one of said first and second sub-panels is rotated or flipped with respect to the other sub-panel prior to being mated face-to-face, whereby said substantially identical edge profiles form complementary adjacent tab and recess portions.

9. The modular system recited in claim 1, wherein said first and second hinge members each comprise a continuous hinge.

10. The modular system recited in claim 9, wherein said first and second hinge members are coupled to said central vertical member, said second vertical member and said horizontal member by rivets through holes therein.

11. The modular system recited in claim 1, wherein at least one of said central vertical member, said second vertical member and said horizontal member comprise an acoustical-dampening material.

12. The modular system recited in claim 11, wherein said central vertical member and said second vertical member have different acoustical impedances.

13. The modular system recited in claim 11, wherein said central vertical member and said horizontal member have different acoustical impedances.

14. The modular system recited in claim 11, wherein said second vertical member and said horizontal member comprise materials having different acoustical impedances.

15. The modular system recited in claim 1, wherein at least one of said central vertical member, said second vertical member and said horizontal member comprise a peripheral frame member.

16. The modular system recited in claim 15, further comprising an internal panel coupled within said peripheral frame member.

17. The modular system recited in claim 16, wherein said internal panel and said peripheral frame member comprise materials having different acoustical impedances.

* * * * *